United States Patent [19]

Key

[11] Patent Number: 4,746,301

[45] Date of Patent: May 24, 1988

[54] S-SHAPED COMPLIANT PIN

[76] Inventor: Edward H. Key, R.D. 1, Box 148B, Hershey, Pa. 17033

[21] Appl. No.: 924,271

[22] Filed: Oct. 29, 1986

[51] Int. Cl.[4] ..... H01R 13/428

[52] U.S. Cl. ..... 439/82; 439/751

[58] Field of Search ..... 339/17 C, 220 R, 221 R, 339/221 M, 252 R, 252 P; 439/78, 82, 736, 751, 825–827, 869, 873

[56] References Cited

U.S. PATENT DOCUMENTS

| | | | |
|---|---|---|---|
| 4,415,220 | 11/1983 | Kant | 339/221 R |
| 4,475,780 | 10/1984 | Walter et al. | 339/221 R |
| 4,586,778 | 5/1986 | Walter et al. | 339/221 R |

*Primary Examiner*—Gil Weidenfeld
*Assistant Examiner*—Gary F. Paumen

[57] ABSTRACT

A solderless electrical contact commonly called a press-fit contact pin includes a press fit section comprising, in cross section, a double open curved or arcuate section generally resembling an "S" shape and a longitudinal section having tapering cross-section to provide a lead-in angle. More particularly, the press-fit section has curved faces each formed from an arc of radius defined as $$R = \frac{(S - T)^2 + L^2}{4(S - T)}$$

where R is the radius, S is the height of the rectangular blank, T is the thickness of the material disposed between said curved surfaces at their closest point, and L is the length of the press-fit section.

15 Claims, 1 Drawing Sheet

S-SHAPED COMPLIANT PIN

BACKGROUND OF THE INVENTION

The present invention relates to an electrical contact and, more particularly, to a contact which may be inserted into an aperture within an insulated mounting board assembly including a printed circuit board, for making electrical contact with conductive paths thereon without requiring solder. The contact is also utilized to make electrical contact with other conductive elements associated with the printed circuit board.

The modern mounting board assembly includes a number of small contact receiving holes on a mounting board located within a small area. Typically, these are plated holes. It is generally envisioned that a contact pin or the like will extend through each hole and make electrical connections with predetermined electrical components and/or the board itself. Because of the proximity of the board holes and therefore the contact pins, it is desirable to secure the pins to the mounting board without the use of external anchoring means. This has been most frequently accomplished with press-fit contact pins. Such pins have a press-fit section which is collapsibly inserted into the mounting board hole to exert a radial force on the portion of the board defining the hole. Frictional interaction between the press-fit section and the portion of the board defining the hole translates such radial force into a push-out force which retains the pin within the hole until a force exceeding such push-out force is applied to the pin. It is also highly desirable that a given press-fit pin, when used in holes within a wide range of sizes, be able to provide predetermined, substantially uniform, retention forces and positive internal contact over a large surface area without excessive damage to the hole or the conductive material which may line the hole.

Press-fit contact pins having solid, rectangular press-fit sections have been in common use for many years in the United States. The inherent problems of such pins have long been recognized, particularly that of the required close hole tolerances, the resultant excessive hole damage, the required high push-in forces, the necessity of a sophisticated pin replacement method, consisting of using replacement pins of larger cross section which, in turn, cause even more hole damage, and, the need for reflow soldering to assure the electrical connection needed for certain applications. However, simplicity and low initial cost have remained major considerations in pin choice and it is here that the press-fit contact pin having a solid, rectangular press-fit section enjoys its greatest advantage. Hence, with continued refinement, the performance of such pins has been deemed adequate and such pins have been accepted as the industry standard for some time.

In recent years, there has been a marked increase in the performance requirements for press-fit contact pins. With the advent of multi-layer, printed circuit board backplanes and with the stringent reliability requirement of the telecommunications and computer industries, which are rapidly adopting the printed circuit board backplane approach, has come the need for a press-fit contact pin of considerably improved operating capabilities. Such a pin should provide predetermined, substantially uniform, retention forces when used in holes within a wide range of sizes, i.e., when used in holes which are permitted large tolerances. The pin should distribute radial forces evenly enough within such holes to thereby provide positive, internal contact over a large surface area and minimize damage to the integrity of the hole and to conductive materials which may line the hole, provide sufficient push-out force to withstand the rigors of wire-wrapping and handling without requiring excessive push-in force, and obviate the need for specially sized replacement pins and reflow soldering.

Various contact pins, having press-fit sections departing from the traditional, solid, rectangular press-fit section, have been proposed. by way of example, two of such pins are discussed by P. J. Tamburro of Bell Laboratories, Whippany, N.J., in his paper, "RELIABILITY OF PRESS-FIT PINS IN PRINTED WIRING BOARDS". However, such pins have not been entirely effective in providing the aforesaid stated desired operating capabilities. Particularly, such pins are not able to operate in mounting board holes with large tolerances, e.g., in 0.040 inch "normal" holes with ±0.005 inch tolerance. Moreover, such pins have necessitated the sacrifice of the advantages of simplicity and low initial cost.

Key, in U.S. Pat. No. 4,017,143, discloses an improved compliant pin including a press-fit section comprising, in cross section, an open, curved arcuate segment, generally resembling a "C" shape. The dimensioning of the "C"-shaped press-fit section and the ductility-elasticity of the material from which it is formed are such that, when the pin is inserted into any one of a number of holes in a mounting board of a wide range of sizes, the "C"-shaped press-fit section undergoes plastic deformation in a substantial portion thereof.

"C"-shaped press-fit pins have not been completely satisfactory. Because the pin is asymmetrical in shape, the radial forces against its structure are not circumferentially uniform. Hence, there is no radial force at the mouth of the pin, and this is opposed by a substantial radial force at its backbone. The difficulty of this is that the pin, through repeated use, becomes deformed or structurally stressed and may even fail, causing problems with contact. It is desirous that a pin be provided that would have increased life over the "C"-shaped pins and which would advantageously provide firm, secure and assured contact with board holes for extended periods of time.

SUMMARY OF THE INVENTION

The present invention relates to further improvements in the art comprising a press-fit pin having a press-fit section which, in cross section, is a double open, curved or arcuate segment generally resembling an "S" shape. The "S" shape has smooth, continuous inner and outer curved surfaces, and the ends of the "S" shape do not come into contact with the longitudinal backbone of the pin either before or after insertion into a mounting board hole. The dimensions of the "S"-shaped press-fit section and the ductility-elasticity of the material from which it is formed are such that when the pin is inserted into holes within a wide range of sizes, the "S"-shaped press-fit section undergoes deformation in a substantial portion thereof.

Upon insertion of a press-fit contact pin, according to this invention, into holes within a wide range of sizes, predetermined substantially uniform, retention forces are developed. Radial forces are distributed evenly enough within such holes to provide positive internal contact with the hole or the conductive material which may line the hole, over a large surface area thereof, while at the same time, minimizing damage to the hole and to the conductive material. Sufficient push-out forces are developed to withstand the rigors of wire-wrapping and handling without requiring excessive push-in force. The need for special oversize replacement pins and reflow soldering is eliminated.

Further, the "S"-shaped press-fit of this invention is characterized by arcuate arms, which on the pin's longitudinal axis, taper toward a reduced thickness at each end thereof. This configuration provides two uniformly stressed beam sections which allow the radii of each arcuate arm to better conform to various sized apertures. A further advantage of the pin of this invention over the "C"-shaped pin is that present pins are self-centering within board holes to provide more certain contact even after repeated use. Because of the asymmetrical cross-section of the pin of this invention, radial forces are uniform at opposite sides throughout the pin cross-section. With the "C"-shaped pin there are no radial forces against the pin at the mouth of the "C" shape. This is opposed by a substantial opposite radial force against the "backbone" of the "C". Through continual use, this asymmetry causes the pin to misalign with the hole and to cause contact problems.

The "S"-shaped pin of the present invention is substantially improved over "C"-shaped pins in maintaining hole allignment throughout an increase life. Further, other advantages of the "S"-shaped pin of the present invention are that the pin may be shaped out of wire—an advantage over formation out of strip. Wire is appropriate because it has relatively sharp corners for wire wrapping and has four relatively smooth flat surfaces for mating. The "S" shape may be easily formed from the body of a wire pin. Further, when wire is utilized to form the pin, it results in being shaped with a natural lead-in angle, a decided advantage in the formation of these pins over those known in the art.

Kant, U.S. Pat. No. 4,415,220, shows an electrical terminal pin used for engagement through a plated-through hole in a printed wiring board where the compliant section of the pin includes a transition section with a shape as described by Kant as having a "substantially S-shaped cross section". Kant goes on to describe this shape as having C-shaped arms with a thickness "T" that remains constant throughout the compliant portion; however, with a radii increasing from the minimum value of zero at the elliptical cross section to a maximum value, r, at the fully developed section. Kant indicates that because of the varying radii, the stiffness of the transition sections varies in the axial direction, becoming relatively more compliant as the portion of the fully developed section is approached. What Kant describes as "substantially S-shaped" is not the true classical Latin S-shaped as defined by the Encyclopedia Americana, 1982 Edition, Volume 24, but rather is similar to the cursive majuscule (Roman) S.

The true S-shape of the present invention is characterized by two full developed C potions as opposed to the Kant shape which has two tight C sections with elongated—and hence—stiff bodies. The ratio of the arcuates section of the longitudinal section is much greater with the true S-shape which characterizes the present invention than with the cursive S of Kant.

The differences in shape, furthermore, are critical. First of all, the particular manufacturing process which characterizes the process used to produce the present invention, has been found to have particular advantage over other manufacturing processes. It is only with the present process that compliant pins, useful over a wide range of applications and having particular characteristics of the pin of the present invention, may be fabricated easily and in large numbers in a short time. By the manufacturing process of the present invention, the portion of the pin to be shaped into the compliant section is, in an initial step, pressed into a "step" shape by the application of two opposing forces, and then in a second and separate processing step, is folded into the S-shape by a compressing and rotating force, utilizing a cylindrical prism as the coining tool. This process is illustrated in the drawing as described in detail later. FIG. 3 is a cross-section of the compliant section of the pin immediately after the first manufacturing step, and FIG. 4 is the cross-section of the pin after the application of the second processing step. The cursive S-shaped compliant pin of Kant simply cannot be formed by this simple two-step process, but must be formed by a much more complicated shaped cooling process. Also, it appears that the pin of the Kant invention may only be formed from square wire, while the pin of the present invention may be fabricated from round, square or rectangular wire or strip.

Another advantage of the S-shape of the present application is that it results in uniform stress distribution when the compliant pin is inserted into the holes of a mounting board. This results in a better and firmer fit and in less damage to the hole, which leads to another advantage of the shape of the present invention. The Kant Patent states that its transition section "conditions" the hole, meaning that the pin makes the small hole larger to better accept the large compliant section. Precisely, this is what the present invention avoids. Making the hole larger is damaging and makes impossible the continuing secure fit that can be provided by the pin of the present invention. The true S-shape of the present invention carefully limits the stress on the entire hole so as not to cause damage with the transition section or any section of the compliant pin. The present transition section is designed to always be smaller than the hole. The compliant section of the present invention results in a gradual transition from the lead-in section to the fully developed section which does not exceed the compressive yield strength of the plated-through hole.

In summary, the electrical contact of the present invention is describable as an electrical connection apparatus including a mounting board having a plurality of spaced holes of a wide range of sizes and a plurality of contact pins adapted to be partially contained in the board holes, the improvement wherein each of the contact pins has a press-fit section comprising, in cross section, a double curved or arcuate, generally "S"-shaped segment having smooth continuous inner and outer curved surfaces which remain open in that the end portions of each "S"-shaped segment do not contact the longitudinal body of said pin and have a freedom of motion both before and after the press-fit section is inserted into the holes, the press-fit section being dimensional and formed of a material whereby the press-fit section undergoes plastic deformation in a substantial portion thereof upon insertion into any one of a wide range of holes.

BRIEF DESCRIPTION OF THE DRAWINGS

Further and additional objects and advantages will appear from the description, accompanying drawings and appended claims. For a more complete understanding of this invention, reference should now be had to the embodiment illustrated in greater detail in the accompanying drawings and described below by way of an example of the invention.

In the drawings.

While the invention will be described in connection with a particular embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
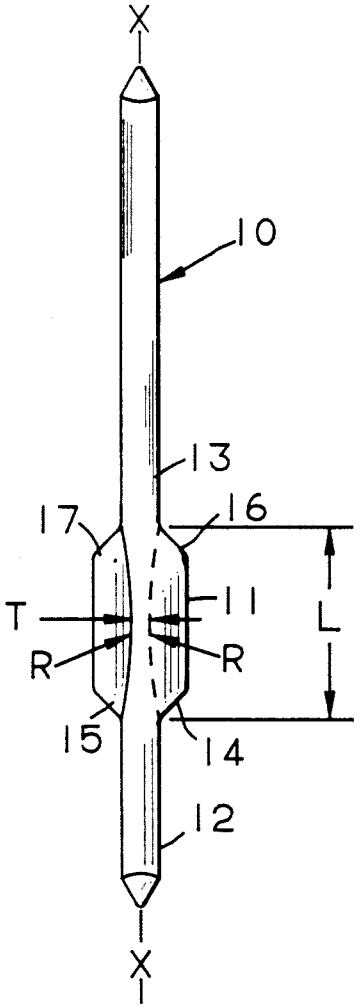
FIG. 1 is a perspective view of a contact pin embodying press-fit mounting principles of this invention.

Turning now to the drawings, FIG. 1 shows contact pin 10 with press-fit section 11 which embodies principles of this invention. Contact pin 10 further has first contact portion 12 and second contact portion 13. Press-fit section 11 comprises shoulders 14 and 15 upper transition areas 16 and 17.

Figure 2:
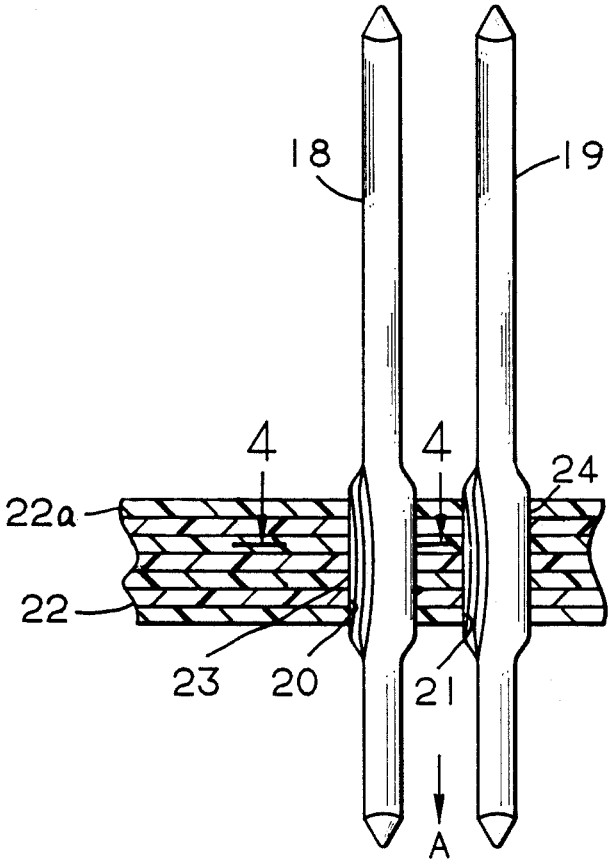
FIG. 2 is a perspective view of contact pins of this invention shown inserted through a circuit board.

In FIG. 2, the pins 18 and 19 of the present invention are inserted in the direction A through the circuit board holes 20 and 21. Each contact pin 18 and 19 is mounted on the board 22 by frictional engagement of a press-fit section 23 and 24 with a portion of the board defining the respective hole. The press-fit sections 23 and 24 simultaneously establish electrical contact with each conductive circuit element 22*a* which has a portion exposed at the respective hole. In the interest of concise description, and since numerous mounting boards are well known in the art and may be employed without departing from the nature and scope of the invention, board 22 is not described in greater detail herein.

Turning back to FIG. 1, the contact pin includes a press-fit section 11 and a first contact portion 12 joined to one end of the press-fit section 11, and a second contact portion 13 joined to the distal end of the press-fit section 11. The first contact portion 12 is adapted to be positioned through a circuit board hole, as shown in FIG. 2, and to extend to the opposite side of the board. When in place, the portion 12 thus is positioned for electrical contact with any desired electrical component. The illustrated portion 12 is a plain shank such as is used for wire-wrap attachment for an electrical conductor. The second contact portion 13 is adapted to be positioned above a board for mating with a contact or conductor of another electrical component. Where the portion 12 joins the press-fit section 11, two shoulders 14 and 15 extend substantially perpendicularly from axis X—X of the pin. The push-in force necessary to insert the pin within a hole is applied to such shoulders 14 and 15.

It should be understood that a variety of first and second contact portion configurations may be employed in the contact pins without deviating from the scope of this invention.

Nevertheless, it has been found that compliant pins characterized by press-fit sections as hereinafter described are particularly useful and advantageous in insertion into insulated mounting board assemblies.

Figure 4:
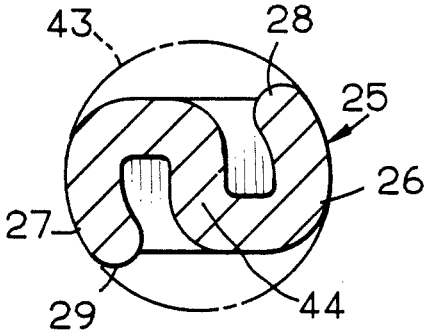
FIG. 4 is a cross-section of the pin through section 4—4 after application of the second processing step.

The press-fit section 11 comprises, in cross-section 25, as seen in FIG. 4, open, double curved or arcuate segments 26 and 27, generally resembling an "S"-shape, having smooth, continuous inner and outer curved surfaces. The control section, 44, of the "S"-shaped segment has, on each of the two opposite sides, which are disposed parallel to the longitudinal axis X—X of the pin, a curved face of radius R. (See FIG. 1). The dimensioning of the "S"-shaped cross-section 25 and the ductility-elasticity of the material from which it is formed, are important in achieving the desirable operating capabilities of this invention. More particularly, in accordance with this invention, the configuration, relative dimensions and ductility-elasticity of the "S"-shaped design are selected to provide a press-fit section 11 which, when inserted into holes within a wide range of sizes, will be radially compressed and deformed to operate within the plastic deformation range of the material to provide predetermined, substantially uniform, retention forces and to provide positive, internal contact over a large surface area without excessive damage to the hole or to conductive material which may line the hole.

Specifically, the diameter, thickness and length of the open, curved or arcuate segment comprising the "S"-shaped cross-section, and the yield stress of the material from which the "S"-shaped cross-section is formed, are such that, when the "S"-shaped cross-section 25 is inserted into holes within a wide range of sizes, the stess in the "S"-shaped cross-section will exceed the yield stess of such material and the "S"-shaped cross-section will undergo inelastic or plastic deformation. The smooth, continuous inner and outer curved surfaces of the "S"-shaped cross-section insure that such stress is not confined to a particular portion of the "S"-shaped cross-section. Rather, such stress is distributed throughout the entire "S"-shaped cross-section. That is to say, a substantial portion of the "S"-shaped cross-section 28 will undergo inelastic or plastic deformation when the "S"-shaped cross-section is inserted into such holes.

In the illustrative embodiment, the inner and outer surfaces of the "S"-shaped cross-section are disposed such that the "S"-shaped cross-section has a substantially uniform thickness. Other configurations of the "S"-shaped cross-section may be employed without departing from the scope of this invention, so long as the inner and outer surfaces of the "S"-shaped cross-section smooth, continuous curves. Thus, for example, in accordance with known tapered beam loading principles, the "S"-shaped cross-section may be tapered at its ends.

The retention forces developed upon insertion of the "S"-shaped cross-section 25 into such holes will; because of the plastic deformation of the "S"-shped cross-section, be substantially uniform. Thus, if the pin is inserted into holes having different diameters, e.g., a maximum hole and a minimum hole, the "S"-shaped cross-section is deflected beyond its elastic range in each case, and a nearly equal amount of force will be exerted by the "S"-shaped cross-section against the portions of the board.

Moreover, the diameter, thickness and length of the "S"-shaped cross-section 25 are such that, upon insertion fo the "S"-shaped into holes within a wide range of sizes, a maximum amount of stressed material is provided in such holes. Such maximum amount of material provides a large surface area of contact between the press-fit sections and such holes, and provides for good stress distribution within the "S"-shaped cross-section such that a desired push-out force may be achieved and the press-fit section will operate in a minimum hole without requiring the material in the press-fit section to operate near a failure stress.

The present invention is intended to include press-fit pins having "S"-shaped cross-sections where the ratio of the thickness T to the diameter d is greater than 1:10, and the ratio of the thickness T to the length L is greater than 1:25.

The ends 28 and 29 of the "S"-shaped cross-section 25 are rounded to alleviate the hazard of rupturing of any conductive material which may line the hole, upon insertion of the pin.

The material making up the press-fit section preferably has a high initial stiffness to provide desired retention force upon undergoing minimum displacement required for insertion of the "S"-shaped cross-section into a maximum hole. Moreover, the material preferably is able to withstand severe plastic deformation upon undergoing maximum displacement required for insertion fo the "S"-shaped cross-section into a minimum hole, without approaching failure.

In addition to the material and dimensioning of the "S"- shaped cross-section, the transition areas 14 and 15 (as shown in FIG. 1) are important to achieving the desired operating capabilities in the illustrated embodiment. The transition areas 14 and 15 between the press-fit section 11 and the first contact portion 12, must be strong enough to withstand the rigors of wire-wrapping and handling. The lower transition areas 14 and 15 must not affect the force characteristics of the press-fit section and must be capable of slipping through a minimum hole without excessively damaging the integrity of the hole or rupturing the conductive material which may line the hole. The upper transition area 16 and 17 between the press-fit section 11 and the second contact portion 13, similarly, must not affect the force characteristics of the press-fit section, and also must be strong enough to withstand a portion of bending moments.

Figure 3:
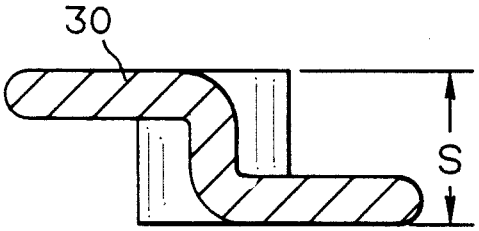
FIG. 3 is a cross-section of the compliant section of a pin immediately after application of a first manufacturing step.

FIGS. 3 and 4 further illustrate the compliant pin during stages of the manufacturing process used to fabricate this item. FIG. 3 shows a cross-section 4—4, 30, through the pin immediately after the application of the first step of the two-step manufacturing process. Two opposing forces are applied to the pin at its cross-section so as to flatten it and to conform it to a step shape as shown, typically, 0.025 inches. FIG. 4 shows the pin immediately after the application of the second step of the manufacturing process. A forming tool in the shape of a split cylinder of a particular diameter is applied to the cross-section of the pin to shape it as shown. The circumference 43 shows, in phantom, the application of the forming tool in cross-section. Typically, this tool may have a diameter of 0.046 inches. The actual shape of the compliant section may be determined by the size of the forming tool. In shape, the forming tool is a split cylinder of the particular diameter desired.

The following general example illustrates a press-fit section constructed according to this invention for a range of holes from a minimum hole (0.035") to a maximum hole (0.045"), i.e., for holes having a nominal size of 0.040" and permitted tolerance of ±0.005".

EXAMPLE

A press-fit section for engaging holes within a range of from 0.035" to 0.045" diameter and constructed according to this invention comprises an open, curved or arcuate segment, generally resembling an "S"-shape. The length L of the "S"-shape is approximately 0.080". The diameter d of the "S"-shape is approximately 0.050". The thickness t of the "S"-shape is approximately 0.014". The ratio of the thickness t to the length L of the "S"-shape is at least 1:10 and typically, about 1:25. The ratio of the thickness t to the diameter d of the "S"-shape is, therefore, about 0.200. The material making up the "S"-shape is generally copper alloy plated with tin alloy or precious metal, such as gold or palladium.

The above configuration enables the press-fit section to operate in the wide range of plated-through hole sizes (0.035" to 0.045"). The pin provides sufficient retention forces in the maximum hole without causing excessive damage in the minimum hole. The first approximately 0.003" of diametral displacemet or compression is essentially the approximately 0.005" of displacement upon insertion into a maximum hole, sufficient force results to give proper retention in the maximum hole. In the successive 0.010 inches displacement, upon insertion into a minimum hole, the force buildup due to the additional compression is minimal. This permits use of the same pin in the minimum hole without causing excessive damage to the integrity of the hole or rupturing the conductive material which may line the hole.

The radial force exerted by this press-fit section when at rest in a plated-through hole of a 0.125" G-10 board is at least 1 pound in a maximum hole and yet, does not exceed 100 pounds when at rest in a nominal or minimum plated-through hole. For most applications, the value of the push-out force for removal of the press-fit section from any of the specified holes is at least 8 pounds.

The hereinafter described press-fit sections are substantially more likely to provide adequate fits with insulated mounting board assemblies without suffering wear which would, eventually, cease to provide electrical contact. The advantageously configured press-fit sections are characterized, as shown in the drawings, as having cut sections formed from an arc of radius defined as follows where R equals the radius:

$$R = \frac{(S - T)^2 + L^2}{4\,(S - T)}$$

Where the pin is formed from a blank of rectangular cross-section and S is the short side (height) of the rectangle, L is the length of the cut and T is the thickness between the cuts. The cut section is the void area remaining upon distention of material into arculate segments upon application of the coining tool in the final forming step.

In nearly every instance, rectangular blanks having a height of 0.025 inches are utilized in the present invention. Hence in most cases, the formula above reduces to:

$$R = \frac{(.025 - T)^2 + L^2}{4\,(.025 - T)}$$

The following is a particularly advantageously dimensioned press-fit section. As an example, let S=0.025 inches; L=0.135 inches, and T=0.006 inches. In this example, R=0.24455 inches, or in other words, in this example, the press-fit section of a particularly advantageous compliant pin is characterized by a cut section which is the arc section of a circle having a radius of 0.24455 inches.

Preferably the material of the connector pin may be selected from the groups consisting of copper alloy, nickel alloy and steel alloy.

While particular embodiments of the invention have been shown, it will be understood, of course, that the invention is not limited thereto since modifications may be made by those skilled in the art, particularly in light of the foregoing teachings. It is, therefore, contemplated by the appended claims to cover any such modifications as incorporate those features which constitute the essential features of these improvements within the true spirit and scope of the invention.

What is claimed is:

1. In an electrical connection apparatus including a mounting board having a plurality of spaced holes of a wide range of sizes therein and a plurality of contact pins adapted to be partially contained in said board holes, the improvement wherein each of said contact pins has a press-fit section comprising, in cross-section, a double curved or arcuate, generally "S"-shaped segment having a substantially uniform thickness and having smooth, continuous inner and outer curved surfaces and which remains open in that the end portions of such "S"-shaped segment do not abut one another and have a freedom of movement both before and after said press-fit section is inserted into said hole, said press-fit section being dimensioned and formed of a material whereby said press-fit section undergoes plastic deformation in a substantial portion thereof upon insertion into any one of said wide range of holes.

2. Electrical connection apparatus as in claim 1 wherein said press-fit section exerts a radial force on said board of at least 1 pound but not greater than 100 pounds when at rest in any one of said wide range of holes.

3. Electrical connection apparatus as in claim 1 wherein removal, of said press-fit section from any one of said range of holes into which said press-fit section has been inserted, requires a push-out force of at least 1 pound.

4. Electrical connection apparatus of claim 3 wherein said required push-out force is greater than 8 pounds.

5. Electrical connection apparatus as in claim 1 wherein said holes have diameters of from 0.035" to 0.045".

6. Electrical connection apparatus as in claim 1 formed from a rectangular blank having a height S, wherein a central section of the S-shaped segment has, on each of two opposite sides which are substantially parallel to the longitudinal axis of the pin, a curved face formed from an arc of a circle having a radius represented by the relationship:

$$R = \frac{(S - T)^2 + L^2}{4\,(S - T)}$$

where R is the radius of said circle, T is the thickness of the material disposed between said curved faces at their closest point, and L is the length of the central section.

7. Electrical connection apparatus as in claim 6 formed from a rectangular blank having a height of 0.025 inches, wherein the radius is represented by the relationship:

$$R = \frac{(.025 - T)^2 + L^2}{4\,(.025 - T)}$$

where R, T and L are expressed in inches.

8. Connector pin as in claim 7 wherein said "S"-shaped cross-section has a thickness to length ratio of greater than 1:25.

9. Connector pin as in claim 7 wherein said material has a high initial stiffness such that said "S"-shaped cross-section will undergo such inelastic deflection in a substantial portion thereof upon minimum displacement required for insertion into a maximum hole and said material is able to withstand severe inelastic deflection undergoing maximum displacement required for insertion into a minimum hole without approaching failure stress.

10. A connector pin for press-fit engagement in a hole of a mounting board assembly having holes of a wide range of sizes, the improvement comprising said pin having a press-fit section which is of a double curved or arcuate, generally "S"-shaped cross-section having a substantially uniform thickness and having smooth, continuous inner and outer curved surfaces and which remains open in that the end portions of such "S"-shaped cross-section do not abut one another and have a freedom of movement both before and after said press-fit section is inserted into such holes in such mounting board assembly, said press-fit section having a pre-insertion outer lateral dimension of about 0.050 inches, a thickness to lateral dimension ratio of at least 1:10, and being of a material such that upon insertion of said segment into any one of said mounting board holes substantially throughout said range of hole sizes, it is inelastically deflected, thereby effecting secure retention in any of such holes without damaging such board.

11. The connector pin of claim 10 wherein said material selected from the group consisting of copper alloy, nickel alloy and steel alloy.

12. Electrical connection apparatus as in claim 10 formed from a rectangular blank having a height S wherein a central section of the S-shaped segment has, on each of two opposite sides which are substantially parallel to the longitudinal axis of a pin, the curved face formed from an arc of a circle having a radius represented by the relationship:

$$R = \frac{(S - T)^2 + L^2}{4\,(S - T)}$$

where R is the radius of said circle, T is the thickness of the material disposed between each of the curved faces at their closest point, and L is the length of the central section.

13. Electrical connection apparatus as in claim 12 formed from a rectangular blank having a height of 0.025 inches wherein the radius represented by the relationship:

$$R = \frac{(.025 - T)^2 + L^2}{4\,(.025 - T)}$$

where R, T and L are expressed in inches.

14. In an electrical connection apparatus including a mounting board having a plurality of spaced holes of a wide range of sizes therein and a plurality of contact pins adapted to be partially contained in said board holes, the improvement wherein each of said contact pins has a press-fit section comprising, in cross-section, a double curved or arcuate, generally "S"-shaped segment having smooth, continuous inner and outer curved surfaces and which remain open in that the end portions of such "S"-shaped segment do not abut one another and have a freedom of movement both before and after said press-fit section is inserted into said hole, said press-fit section being dimensional and formed of a material whereby said press-fit section undergoes plastic deformation in a substantial portion thereof upon insertion into any one of said wide range of holes, wherein said contact pin is formed from a rectangular blank having a height S wherein a central section of "S"-shaped segment has, on each of two opposite sides which are substantially parallel to the longitudinal axis of the pin, a curved face formed from the arc of a circle having a radius represented by the relationship:

$$R = \frac{(S - T)^2 + L^2}{4\,(S - T)}$$

where R is the radius of said circle, T is the thickness ofthe material disposed between said curved faces at their closest point and L is the length of the central section and wherein when the height of the blank is 0.025 inches, the radius is thereby represented by the relationship:

$$R = \frac{(.025 - T)^2 + L^2}{4\,(.025 - T)}$$

where R, L and T are expressed in inches.

15. A connector pin for press-fit engagement in a hole of a mounting board assembly having holes of a wide range of sizes, the improvement comprising said pin having a press-fit section which is of a double curved or arcuate, generally "S"-shaped cross-section and having smooth, continuous inner and outer curved surfaces and which remains open in that the end portions of such "S"-shaped cross-section do not abut one another and have a freedom of movement both before and after said press-fit section is inserted into such holes in such mounting board assembly, said press-fit sections having a pre-insertion outer lateral dimension of about 0.050 inches, a thickness to lateral dimension ratio of at least 1:10, and being of a material such that upon insertion of said segment into any one of said mounting board holes substantially throughout said range of hole sizes, it is inelastically deflected, thereby effecting secure retention in any of such holes without damaging such board and wherein said pin is formed from a rectangular blank having a height S wherein a central section of the "S"-shaped segment has, on each of two opposite sides which are substantially parallel to the longitudinal axis of the pin, a curved face formed from an arc of a circle having a radius represented by the relationship:

$$R = \frac{(S - T)^2 + L^2}{4\,(S - T)}$$

where R is the radius of said circle, T is the thickness of the material disposed between said curved faces at their closest point and L is the length of the central section and wherein when the height of the blank is 0.025 inches, the radius is thereby represented by the relationship:

$$R = \frac{(.025 - T)^2 + L^2}{4\,(.025 - T)}$$

where R, L and T are expressed in inches.

* * * * *